United States Patent [19]

Shinoda et al.

[11] Patent Number: 4,729,929

[45] Date of Patent: Mar. 8, 1988

[54] HIGHLY CORROSION RESISTANT ALUMINIZED STEEL SHEET FOR THE MANUFACTURE OF PARTS OF EXHAUST GAS SYSTEM

[75] Inventors: Ken-ichi Shinoda; Shohei Fujita, both of Hiroshima, Japan

[73] Assignee: Nisshin Steel Co., Ltd., Tokyo, Japan

[21] Appl. No.: 905,916

[22] PCT Filed: Jan. 14, 1986

[86] PCT No.: PCT/JP86/00012

§ 371 Date: Aug. 27, 1986

§ 102(e) Date: Aug. 27, 1986

[87] PCT Pub. No.: WO86/04361

PCT Pub. Date: Jul. 31, 1986

[30] Foreign Application Priority Data

Jan. 17, 1985 [JP] Japan ..... 60-6294

[51] Int. Cl.[4] ..... B32B 15/18

[52] U.S. Cl. ..... 428/653; 181/244

[58] Field of Search ..... 428/653, 610; 181/244, 181/245; 420/87, 89, 90, 91, 92, 104, 112, 119; 427/320, 431

[56] References Cited

U.S. PATENT DOCUMENTS

| | | | |
|---|---|---|---|
| 3,881,881 | 5/1975 | Kim | 428/653 |
| 3,881,882 | 5/1975 | Hughes et al. | 427/431 |
| 3,905,780 | 9/1975 | Jasper et al. | 428/653 |
| 4,150,178 | 4/1979 | Yagi et al. | 427/431 |
| 4,248,908 | 2/1981 | Nickola | 427/320 |
| 4,264,684 | 4/1981 | Allegra et al. | 428/653 |
| 4,584,211 | 4/1986 | Higuchi et al. | 427/320 |
| 4,591,395 | 5/1986 | Steel, Jr. et al. | 428/653 |
| 4,624,895 | 11/1986 | Nickola | 428/653 |

FOREIGN PATENT DOCUMENTS

| | | | |
|---|---|---|---|
| 41-7923 | 4/1966 | Japan . | |
| 44-17014 | 7/1969 | Japan . | |
| 47-4789 | 2/1972 | Japan . | |
| 49-36091 | 9/1974 | Japan . | |
| 51-32415 | 3/1976 | Japan . | |
| 53-100119 | 9/1978 | Japan . | |
| 9113 | 1/1979 | Japan | 420/91 |
| 54-124817 | 9/1979 | Japan . | |
| 102556 | 8/1981 | Japan | 428/653 |
| 47861 | 3/1982 | Japan | 428/653 |
| 58-27963 | 2/1983 | Japan . | |
| 58-77551 | 5/1983 | Japan . | |
| 58-77554 | 5/1983 | Japan . | |
| 143047 | 8/1984 | Japan | 420/89 |
| 179758 | 10/1984 | Japan | 420/90 |
| 13058 | 1/1985 | Japan | 428/653 |
| 13057 | 1/1985 | Japan | 428/653 |
| 245727 | 12/1985 | Japan | 427/320 |

*Primary Examiner*—John J. Zimmerman

*Attorney, Agent, or Firm*—Wenderoth, Lind & Ponack

[57] ABSTRACT

A highly corrosion resistant aluminized steel sheet comprising a steel substrate consisting essentially of, in % by weight, up to 0.08% of C, from 0.10 to 1.50% of Si, up to 0.50% of Mn, from 0.10 to 0.50% of Cu, preferably from 0.10 to 0.50% of Ni and/or from 0.30 to 5.0% of Cr, the balance being Fe and unavoidable impurities, having on its surfaces hot dip coated aluminum layers. Such an aluminized steel sheet is very resistive against severe corroding conditions involving repeated cycles of exposure to alkaline and acidic drains of an automobile exhaust gas and elevated temperatures, and therefore, is very suitable for the manufacture of parts, such as a muffler, of an automobile exhaust gas system.

5 Claims, 1 Drawing Figure

HIGHLY CORROSION RESISTANT ALUMINIZED STEEL SHEET FOR THE MANUFACTURE OF PARTS OF EXHAUST GAS SYSTEM

FIELD OF THE INVENTION

The present invention relates to a highly corrosion resistant aluminized steel sheet suitable for use in the manufacture of parts of an exhaust gas system. Aluminized steel sheets according to the invention are highly resistive against corroding actions of both alkaline and acidic substances and exhibit an excellent oxidation resistance at an elevated temperature, and therefore are particularly suitable for use in the manufacture of parts of an automobile exhaust gas system, which are subjected to a wet corroding action of drain formed therein and exposed to a hot oxidizing atmosphere.

PRIOR ART

In machines and apparatus, involving combustion of fossil fuels, in particular petroleum fuels, such as internal engines, boilers and heating instruments, the material of those parts coming in contact with a combustion exhaust gas is required to be oxidation resistant at an elevated temperature. As such a material, aluminized steel sheets are known. They are widely used in the manufacture of parts of an automobile exhaust gas system, since they are inexpensive, when compared with heat resistant steels and stainless steels which contain relatively high proportions of expensive alloying elements, and still have a certain extent of oxidation resistance at an elevated temperature. Especially, in view of their improved heat resistance, Type I aluminum hot dip coated steel sheets having a suitable amount of Si incorporated in the Al coatings are used in the above-mentioned applications. As the steel substrate of such aluminized steel sheets, Ti-added chromium steels are known.

For example, JP, No. 52-33579 discloses a heat resistant aluminized steel sheet having a substrate of chromium alloy steel consisting essentially of, in % by weight, at least 5% but less than 15% of Cr, up to 2.0% of Si, up to 0.1% of C, and preferably at least one of Ti, Zr and Nb in an amount sufficient to react with the carbon and nitrogen in the steel to form carbides and nitrides, the balance being Fe and unavoidable impurities.

JP, No. 56-102556 discloses a heat resistant aluminized steel sheet having a steel substrate consisting essentially of, in % by weight, from 0.001 to 0.02% of C, from 0.02 to 5% of Cr, from 0.05 to 1.0% of Mn, from 0.04 to 2.0% of Si, from 0.01 to 0.10% of Al, up to 0.010% of N, and from 0.2 to 0.6% of Ti, the ratio Ti/(C+N) being at least 20, the balance being Fe and unavoidable impurities.

In addition to such aluminized steel sheets, some chromium-containing steel alloys have also been proposed for use in the manufacture of parts of an automobile exhaust gas system.

For example, JP. No. 54-23327 discloses an oxidation resistant steel having excellent workability and processability consisting essentially of, in % by weight, more than 5% but less than 11.5% of Cr, from 0.5 to 2.0% of Si, up to 0.05% of C, from 0.1 to 0.4% of Mn, and optionally at least one of Ti and Zr in an amount sufficient to combine with C and N in the steel to form carbides and nitrides thereof, the balance being Fe and unavoidable impurities.

JP, No. 54-35571 discloses an oxidation resistant steel consisting essentially of, in % by weight, more than 3.0% but not more than 6.0% of Cr, from 0.5 to 2.0% of Si, more than an amount as unavoidable impurities but not more than 4.0% of Al, up to 0.5% of Mn, up to 0.05% of C, and optionally at least one of Ti and Zr in an amount of up to 0.9%, the balance being Fe and unavoidable impurities.

JP, No. 58-224148 discloses a chromium steel suitable for use in the manufacture of parts of an automobile exhaust gas system consisting essentially of, in % by weight, up to 0.02% of C, more than 1.5% but less than 3.0% of Si, up to 0.50% of Mn, more than 5.0% but less than 10.0% of Cr, from 0.05 to 0.80% of Cu, up to 0.003% of S, up to 0.02% of N, and optionally at least one of Ti, Nb and Zr in an amount of up to 0.30% in total, the balance being Fe and unavoidable impurities.

JP, No. 59-179758 discloses a highly corrosion resistant chromium steel suitable for use in the manufacture of parts of an automobile exhaust gas system consisting essentially of, in % by weight, up to 0.02% of C, from 0.30 to 2.0% of Si, up to 1.0% of Mn, more than 5.0% but less than 10.0% of Cr, from 0.05 to 0.80% of Cu, from 1.0 to 4.0% of Al, up to 0.003% of S, up to 0.02% of N, and optionally at least one of Ti, Nb and Zr in an amount of up to 0.50% in total, the balance being Fe and unavoidable impurities.

PROBLEMS IN THE ART

For a material used in the manufacture of parts of an automobile exhaust gas system, it is an important requirement that the material has not only an oxidation resistance at an elevated temperature but also a resistance against wet corroding actions of both alkaline and acidic substances. For example, in an automobile exhaust gas system, an exhaust gas which has left a converter (an apparatus for treating the exhaust gas with catalysts) is caused to pass through a central tube, a muffler and a tail tube, and eventually exhausted outside the automobile body. At the time the engine is started, the exhaust gas system is not yet warmed up, and thus moisture in the exhaust gas is condensed to accumulate in the muffler or adhere to walls of the tubes. The drain (condensed moisture) eventually evaporates as the temperature of the exhaust gas system rises, during which the nature of the drain changes from alkaline to acidic. This is believed because various components in the exhaust gas dissolve in the drain to different degrees depending upon the temperature, and in the course of evaporation of the drain various dissolved components decompose and spread to different degrees depending upon the temperature.

Conventional aluminized steel sheets (Type I aluminized steel sheets having a suitable amount of Si in the coatings) have been found unsatisfactory in that the Al—Si coating layer is insufficiently resistant against the corrosive action of the alkaline drain, while the steel substrate is insufficiently corrosion resistant to the acidic drain.

Further, regarding wet corrosion in which water takes part, it is a well-known phenomenon that when a joint of different metals having different standard electrode potentials is wetted, a corrosion current flows between the metals through the water so that one of the metals may be corroded to a greater extent than the other. In an automobile exhaust gas system in which an Al—Si hot dipped steel sheet is partly utilized, joints of the Al—Si hot dipped steel sheet and other metal (special steel or stainless steel) are found everywhere, and thus, a phenomenon also presents itself that the Al—Si hot dipped steel sheet side is more readily corroded than the other metal due to the difference in the standard electrode potentials between aluminum and iron.

FIG. 1 is a microscopic photograph of a cross-section of that part of a muffler equipped in an automobile, which part is made of an aluminized steel sheet, showing an initial stage of corrosion. It is revealed that the corrosion starts with the inside of the aluminum coating layers, that is the steel substrate, and proceeds as if corrosion products would cause peeling of the aluminum coating layers. It is believed that if the aluminum coating layers have defective portions, such as pin holes, cracks formed upon shaping or portions where the coating has locally disappeared upon welding, the substrate steel at such defective portions is exposed and brought in contact with the above-mentioned acidic drain, whereby a local cell is formed between the steel and the aluminum coating, which has no self-sacrificing cathodic activity as possessed by Zn, and thus, the corossion proceeds.

It should be noted that when an aluminized steel sheet is in contact with an exhaust gas drain, corrosion start with the steel substrate of the aluminized product.

One conceivable approach to avoid such corrosion would be to eliminate defects, such as pin holes and cracks, in the aluminum coatings. For this purpose, after having been shaped into a desired shape, the aluminized steel sheet may be heated to an elevated temperature as high as 700° C. or hither sufficient to re-melt the aluminum coatings. Such an approach is, however, impractical, since it poses another problem in that the shaping accuracy is frequently lowered due to heat distortion involved.

Aluminized steel sheets described in the above-mentioned JP, Nos. 52-33579 and 56-102556 have an improved oxidation resistance at an elevated temperature, but they do not have a satisfactory resistance against the corroding actions of an automobile exhaust gas drain. Further, they are expensive materials, since the steel substrate of them contains a quantity of Cr (JP, No. 52-33579) or Ti in an amount sufficient to combine the C and N in the steel (JP, No. 56-102556).

In order that an aluminized steel sheet is well resistive to wet corrosion of an exhaust gas drain and to oxidation at an elevated temperature, the steel substrate in itself should be well resistive to wet corrosion of an exhaust gas drain and to oxidation at an elevated temperature.

As mentioned herein above, JP, Nos. 54-23327 and 54-35571 propose oxidation resistant steels suitable for use in the manufacture of parts of an automobile exhaust gas system. But these Japanese patent post-examination publications do not address the problem of wet corrosion. Further, the desired oxidation resistance is achieved at the cost of more than 5% of Cr, unless Al is intentionally added (JP, No. 54-23327). The Cr content required to achieve the oxidation resistance can be reduced to a level of 6% or less by adding Al, but Al tends to adversely affect the workability of the product (JP, No. 54-35571). It is taught in these publications that the workability may be improved by adding Ti and/or Zr. Obviously, Ti and Zr are very expensive.

JP, Nos. 58-224148 and 59-179758 propose highly corrosion resistant chromium steels suitable for use in the manufacture of parts of an automobile exhaust gas system. It is emphasized in these Japanese patent laid-open applications that more than 5% of Cr is essential to achieve the desired corrosion and oxidation resistances at an elevated temperature.

Accordingly, even if an attempt is made to prepare an aluminized steel sheet using the chromium steels, which are proposed in these JP specifications as being suitable for manufacturing parts of an automobile exhaust gas system, a satisfactory resistance against wet corroding actions of the drain of the exhaust gas is not necessarily ensured, and the product becomes expensive.

SUMMARY OF THE INVENTION

An object of the invention is to solve the above-discussed problems.

It has now been found that the corrosion and oxidation resistances desired for a material of parts of an automobile exhaust gas system can be achieved even with minimum proportions alloying elements, by an aluminized steel sheet having a steel substrate in which Si and Cu, and preferably further Ni and Cr, are suitably balanced.

Thus, the invention provides:

a highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, and from 0.10 to 0.50% of Cu, the balance being Fe and unavoidable impurities, having on its surfaces hot dip coated aluminum layers;

a highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, from 0.10 to 0.50% of Cu, and from 0.10 to 0.50% of Ni, the balance being Fe and unavoidable impurities, having on its surfaces hot dip coated aluminum layers;

a highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, from 0.10 to 0.50% of Cu, and from 0.30 to 5.0% of Cr, the balance being Fe and unavoidable impurities, having on its surfaces hot dip coated aluminum layers, a highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, from 0.10 to 0.50% of Cu, from 0.10 to 0.50% of Ni, and from 0.30 to 5.0% of Cr, the balance being Fe and unavoidable impurities, having on its surfaces hot dip coated aluminum layers; and a highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, from 0.10 to 0.50% of Ni, and from 0.30 to 5.0% of Cr, the balance being Fe and unavoidable impurities, having on its surfaces hot dip coated aluminum layers.

DETAILED DESCRIPTION OF THE INVENTION

Figure 1:
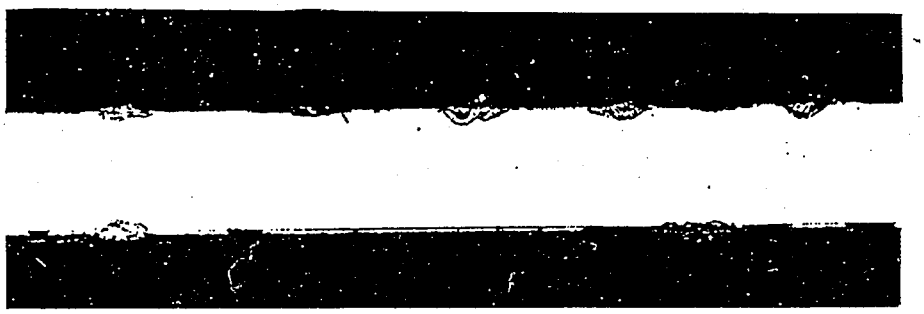
FIG. 1 is a microscopic photograph (at a magnification of 20) of a cross-section of that part of a muffler equipped in an automobile, which part is made of a commercially available aluminized steel sheet, showing an initial stage of corrosion at the end of 6 months and 4000 km running. In the photograph the white layer is the steel substrate, and the thin layers sandwiching the steel substrate are aluminum coatings.

A highly corrosion resistant aluminized steel sheet suitable for use in the manufacture of parts of an exhaust gas system, according to the invention is characterized by its steel substrate in which Si and Cu, and preferably further Ni and Cr, are suitably balanced to solve the above-discussed problems. The aluminum coatings in themselves may be the same as those in the known aluminized steel sheets. As is the case with the known heat resistant aluminized steel sheets, the aluminized steel sheet according to the invention may be prepared by dipping a steel substrate having the prescribed composition in a bath of molten aluminum containing from 5 to 15% by weight of Si, to provide the substrate with coating layers of an Al—Si alloy containing from 5 to 15% by weight of Si.

Functions and critical proportions of individual alloying elements in the steel substrate of the aluminized steel sheet according to the invention will now be described.

C in the substrate steel acts to impair the corrosion resistance of the steel, and therefore, the less the C content the better. However, an attempt to reduce the carbon content to an extraordinarily low level is contrary to the purpose of the invention to provide an inexpensive material, allowing for the costs of decarburization. We have found that in the aluminized steel sheet according to the invention, in which the corrosion resistance of the substrate steel is improved by suitably balancing Si and Cu, and further Ni and Cr, up to 0.08% of C in the substrate steel is tolerable.

Si in the substrate steel improves the oxidation resistance of the steel at an elevated temperature. Furthermore, we have found that Si synergistically cooperates with Cu and/or Ni (in particular with Cu) to enhance the resistance against corrosive actions of the drain of an automobile exhaust gas as well as the oxidation resistance when heated to a temperature of about 500° C. Such effects of Si are remarkable especially in low Cr ranges, and become more prominent as the Si content is increased. For this purpose at least 0.3% of Si is required. However, with a steel sunstrate containing Si in an amount substantially in excess of 1.50%, it is not easy to carry out the aluminum hot dipping process. For this reason the upper limit for Si in the substrate steel is set as 1.50%.

From a viewpoint of the corrosion resistance, the less the Mn content in the substrate steel the more preferred. But Mn is needed for deoxidation and sulfide formation in the steel making process. For the purpose of the invention up to 0.50% of Mn may be tolerated.

Cu in the steel substrate is the most characteristic element. When an aluminized steel sheet is exposed to drain of an exhaust gas, the drain penetrate defects of the aluminum coating such as pin holes and crackings formed when worked, and a local cell is formed between the substrate steel and the aluminum coating. In the presence of the drain, and in particular under an oxidising atmosphere at an elevated temperature, corrosion products are formed beneath the aluminum coating layers and grow up there. We have found that Cu in the steel substrate serves to prevent the drain from attacking the substrate steel. We have also found that this beneficial effect of Cu may be greatly promoted by the coexisting Si. Thus, an aluminized steel sheet which is well resistive against the attack of the corroding drain has now been obtained by adding suitable amounts of Si and Cu to the substrate steel. For the purpose of the invention, at least 0.10% of Cu is required. However, addition of an excessive amount of Cu gives rise to not only cracks or surface flaws of slabs due to brittleness when hot worked, but also reduction in the workability owing to precipitation hardening of Cu. For these reasons we now set the upper limit for Cu as not more than 0.50%.

Ni in the steel substrate increases the solubility of Cu in the steel, thereby to promote the above-discussed effects of Cu. Further, Ni in itself improves the corrosion resistance of the steel. In addition, Ni acts to suppress the brittleness under hot working which might be caused by Cu. For such effects of Ni to be appreciable, at least 0.10% of Ni will be required. But the beneficial effects of Ni tend to be saturated as the Ni content approaches and exceeds about 0.50%. From an economical viewpoint, the upper limit for Ni is now set as 0.50%.

As is well known, Cr is an alloying element which improves the corrosion and oxidation resistances of the steel at an elevated temperature. Also in the case of the aluminized steel sheet according to the invention, the corrosion and oxidation resistances at an elevated temperature can be further improved by adding Cr to the steel substrate. We have found that with the aluminized steel sheet having appropriate amounts of Si and Cu in the steel substrate, as is the case with the invention, addition of up to 5.0% of Cr to the substrate steel is sufficient for an effective improvement of the service life of the product exposed to an automobile exhaust gas. Further, as the Cr content in the substrate steel exceeds 5.0%, the aluminizing performance tends to become worse. For these reasons, when Cr is added to the steel substrate, up to 5.0% is sufficient. However, with less than 0.3% of Cr, an appreciable improvement will not be obtained.

The substrate steel of the aluminized steel sheet in accordance with the invention may be produced by a conventional steel making process, and for the purpose of the invention the steel may contain impurities, such as S, N, O and Al, unavoidable in a conventional steel making process in amounts normally coming into the products. This means that the substrate steel can be ecomonically produced, since any special expensive steps such as degasing is not necessarily needed.

The aluminized steel sheet in accordance with the invention is especially suitable as a material for constructing a muffler of an automobile exhaust gas system, in which the drain of the exhaust gas is repeatedly accumulated and evaporated, and which is exposed to an elevated temperature.

EXAMPLES

Molten steels having compositions indicated in Table 1 were prepared in a 30 kg vacuum furnace, cast, hot forged, hot rolled, cold rolled and annealed under the same conditions to prepare steel sheets having a thickness of 1.0 mm. Each sheet, after having the surfaces polished, was dipped in a bath of molten aluminum containing about 10% by weight of Si to provide an aluminized steel sheet having a coating build-up of about 80 g/m$^2$. The aluminized steel sheet so prepared had an intermediate layer of an Al—Fe—Si ternary alloy of a thickness of about 2 to 3 μm between the steel substrate and each of the Al—Si alloy coating layers. The aluminized steel sheets were subjected to the following corrosion tests under the conditions noted below for a prolonged period of time.

Test Specimen

From each aluminized steel sheet so prepared a disc having a diameter of 60 mm was cut out, and semi-spherically bulged at the center thereof by means of an Erichsen testing machine. The buldged cavity had an inner diameter of 25 mm and a maximum depth at the center of 4.0 mm.

(Test I)

This is a corrosion test, in which an alkaline corroding liquid is used, for the purpose of testing the corrosion resistance of the material at an initial stage wherein drain of an automobile exhaust gas is still alkaline.

In this test a test specimen was dipped in an alkaline corroding liquid A as noted below at ambient temperature for 3 minutes, and taken out from the liquid with its semi-spherical cavity (hereinafter referred to as pool) filled with the liquid. The specimen was maintained in warm air at a temperature of 80° C., for a period of 17 minutes, whereby the liquid in the pool was completely evaporated to dryness. This procedure (cycle) was repeated 2000 times.

At the end of the 2000 cycles, the loss in weight (in gr.) and loss in thickness (in mm) of the specimen were determined, and the surface condition of the specimen was visually observed.

Corroding Liquid A

This liquid contains ions as noted below, which are normally found in drain accumulating in a muffler of an automobile exhaust gas system, in the indicated amounts. The pH of the liquid is adjusted at 8.8 with ammonium salts. The addition of the active carbon is to reproduce a condition that amounts of unburnt carbon are deposited in an automobile muffler.

$CO_3^{-2}$: 2000 ppm by weight
$HCO_3^-$: 2000 ppm by weight
$SO_4^{-2}$: 500 ppm by weight
$Cl^-$: 50 ppm by weight
HCHO: 12 ppm by weight
active carbon: 10 g/l (Test II)

This is a corrosion test, in which an acidic corroding liquid is used, for the purpose of testing the corrosion resistance of the material at a stage wherein drain of an automobile exhaust gas has changed its nature from alkaline to acidic in the course of evaporation.

In this test a test specimen was dipped in an acidic corroding liquid B as noted below at ambient temperature for 3 seconds, and taken out from the liquid with its liquid pool filled with the liquid. The specimen was dried at a temperature of 120° C. for a period of 15 minutes, maintained in an air oven at a temperature of 500° C. for a period of 10 minutes, and allowed to cool to ambient temperature. This heating cycle was repeated 120 times. At the end of the 120 cycles, the loss in weight (in gr.) of the specimen was determined, and the surface condition of the specimen was visually observed.

Corroding Liquid B

This liquid contains ions as noted below, which are normally found in concentrated drain (the drain which has initially accumulated in a muffler of an automobile exhaust gas system, and thereafter has been concentrated to a 1/40 volume) in the indicated amounts. The pH of the liquid is adjusted at 4.0 with sulfuric acid.

$SO_4^{-2}$: 20000 ppm by weight
$Cl^-$: 600 ppm by weight
$HPO_4^-$: 200 ppm by weight
$NH_4^+$: 8000 ppm by weight
active carbon: 10 g/l (Test III)

In this test some of the specimens which had been subjected to Test II above, were subjected to the heating cycle of Test II further 250 times. At the end of the cycles (370 cycles in total) the loss in weight (in gr.) of the specimen was determined.

Results of the tests are shown in Table 2.

TABLE 1

| Ex. No | Composition of Steel Substrates | | | | | | | |
|---|---|---|---|---|---|---|---|---|
| | C | Si | Mn | P | S | Cu | Ni | Cr |
| Examples according to the invention | | | | | | | | |
| 1 | 0.05 | 0.58 | 0.30 | 0.014 | 0.011 | 0.46 | 0.01 | 0.02 |
| 2 | 0.07 | 0.17 | 0.27 | 0.013 | 0.003 | 0.31 | 0.01 | 0.01 |
| 3 | 0.04 | 0.92 | 0.28 | 0.011 | 0.008 | 0.28 | 0.02 | 0.02 |
| 4 | 0.03 | 1.42 | 0.24 | 0.012 | 0.013 | 0.13 | 0.01 | 0.01 |
| 5 | 0.04 | 0.61 | 0.23 | 0.020 | 0.010 | 0.25 | 0.26 | 0.03 |
| 6 | 0.06 | 1.02 | 0.27 | 0.018 | 0.009 | 0.29 | 0.43 | 0.01 |
| 7 | 0.05 | 1.06 | 0.27 | 0.013 | 0.022 | 0.26 | 0.12 | 0.01 |
| 8 | 0.03 | 0.23 | 0.31 | 0.016 | 0.012 | 0.21 | 0.31 | 0.37 |
| 9 | 0.05 | 0.62 | 0.25 | 0.019 | 0.018 | 0.33 | 0.30 | 1.20 |
| 10 | 0.04 | 0.54 | 0.22 | 0.020 | 0.005 | 0.30 | 0.26 | 3.93 |
| 11 | 0.04 | 0.94 | 0.27 | 0.016 | 0.009 | 0.29 | 0.48 | 4.04 |
| 12 | 0.04 | 0.42 | 0.27 | 0.014 | 0.012 | 0.44 | 0.31 | 2.00 |
| 13 | 0.04 | 0.67 | 0.30 | 0.010 | 0.008 | 0.15 | 0.02 | 1.95 |
| 14 | 0.05 | 0.40 | 0.24 | 0.009 | 0.014 | 0.14 | 0.15 | 1.92 |
| 15 | 0.03 | 0.70 | 0.19 | 0.013 | 0.006 | 0.31 | 0.01 | 3.99 |
| 16 | 0.03 | 0.45 | 0.25 | 0.041 | 0.016 | 0.15 | 0.14 | 3.97 |
| 17 | 0.04 | 0.70 | 0.27 | 0.013 | 0.006 | 0.03 | 0.43 | 1.80 |
| Comparative examples | | | | | | | | |
| 18 | 0.04 | 0.01 | 0.26 | 0.015 | 0.009 | 0.01 | 0.01 | 0.02 |

TABLE 1-continued

| Ex. No | Composition of Steel Substrates C | Si | Mn | P | S | Cu | Ni | Cr |
|---|---|---|---|---|---|---|---|---|
| 19 | 0.05 | 0.05 | 0.29 | 0.009 | 0.010 | 0.35 | 0.02 | 0.03 |
| 20 | 0.04 | 0.21 | 0.25 | 0.018 | 0.009 | 0.03 | 0.01 | 2.03 |
| 21 | 0.03 | 0.17 | 0.27 | 0.017 | 0.008 | 0.01 | 0.31 | 0.12 |
| 22 | 0.004 | 0.01 | 0.22 | 0.014 | 0.008 | 0.01 | 0.02 | 0.02 |

Steel substrate of Ex. 22 further contains 0.05% of Ti.

TABLE 2

| Example No. | Test Results: Test I Wt. loss (gr) | Test I Th. loss (mm) | Test I Surface Condition | Test II Wt. loss (gr) | Test II Surface Condition | Test III Wt. loss (gr) |
|---|---|---|---|---|---|---|
| Examples according to the invention | | | | | | |
| 1 | 6.2 | 0.131 | smooth | 6.4 | smooth | — |
| 2 | 7.2 | 0.151 | smooth | 5.9 | smooth | — |
| 3 | 6.8 | 0.146 | smooth | 5.0 | slightly roughened | 9.8 |
| 4 | 6.5 | 0.149 | smooth | 5.8 | smooth | — |
| 5 | 4.9 | 0.124 | smooth | 5.1 | smooth | — |
| 6 | 5.5 | 0.130 | smooth | 4.9 | smooth | 8.6 |
| 7 | 5.8 | 0.129 | smooth | 4.7 | smooth | — |
| 8 | 4.1 | 0.117 | smooth | 6.3 | smooth | — |
| 9 | 3.7 | 0.109 | smooth | 5.7 | smooth | 6.3 |
| 10 | 2.3 | 0.093 | slightly roughened | 3.9 | smooth | 4.3 |
| 11 | 2.2 | 0.091 | smooth | 3.4 | smooth | 3.6 |
| 12 | 1.70 | 1.112 | smooth | 4.1 | smooth | 5.6 |
| 13 | 1.90 | 1.130 | smooth | 5.2 | smooth | 4.9 |
| 14 | 1.83 | 1.093 | smooth | 5.0 | smooth | 4.6 |
| 15 | 2.43 | 0.098 | smooth | 3.8 | smooth | 5.2 |
| 16 | 2.03 | 0.095 | smooth | 3.6 | smooth | 3.4 |
| 17 | 4.80 | 0.146 | slightly roughened | 5.1 | smooth | 5.8 |
| Comparative examples | | | | | | |
| 18 | 14.4 | 0.370 | remarkable pitting | 7.9 | smooth | 17.3 |
| 19 | 10.2 | 0.209 | smooth | 6.8 | smooth | — |
| 20 | 11.0 | 0.297 | remarkable pitting | 8.3 | smooth | — |
| 21 | 10.3 | 0.264 | remarkable pitting | 8.0 | smooth | — |
| 22 | 11.6 | 0.286 | remarkable pitting | 7.1 | smooth | — |

From the tests results it is revealed that the aluminized steel sheet in accordance with the invention is well resistive against the severe corroding environment in the automobile exhaust gas system, involving repeated cycles of exposure to alkaline and acidic drains of the exhaust gas and experience of elevated temperatures.

More particularly, in Test I, the aluminized steel sheets of Examples 1 to 17, according to the invention, exhibited very excellent results, when compared with the product of Example 18, the latter product being an aluminized steel sheet having a conventional low carbon steel as the substrate steel. The products of Examples 19 to 22 having added Si or Cu in the substrate steel exhibited results, which were slightly better than those of the product of Example 18 having no added Si or Cu in the substrate steel, but were still much inferior to those attainable by the invention. This means that Si and Cu synergistically cooperate for the purpose of the invention. It is also revealed that addition of Ni and/or Cr in addition to Si and Cu further improves the corrosion resistance.

In Test II, differences of the results among the tested specimens became smaller than in Test I, presumably because of more severe corroding environment in Test II. But the order of the excellence of the corrosion resistance is basically the same as in Test I. Also in Test III, the aluminized steel sheets according to the invention exhibited the corrosion resistance 2 to 3 times that of the product of Example 18.

What is claimed is:

1. A highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, and from 0.10 to 0.50% of Cu, the balance being Fe and unavoidable impurities, having on its surfaces hot dip coated aluminum layers.

2. A highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, from 0.10 to 0.50% of Cu, and from 0.10 to 0.50% of Ni, the balance being Fe and unavoidable impurities, having on its surfaces hot dip coated aluminum layers.

3. A highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, from 0.10 to 0.50% of Cu, and from 0.30 to 5.0% of Cr, the balance being Fe and unavoidable impurities, having on its surfaces hot dip coated aluminum layers.

4. A highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, from 0.10 to 0.50% of Cu, from 0.10 to 0.50% of Ni, and from 0.30 to 5.0% of Cr, the balance being Fe and unavoidable impurities, having on its surfaces hot dip coated aluminum layers.

5. A highly corrosion resistant aluminized steel sheet suitable for use in the manufacture of parts of an exhaust gas system, comprising a steel substrate consisting essentially of, in % by weight, up to 0.08% of C, from 0.10 to 1.50% of Si, up to 0.50% of Mn, from 0.10 to 0.50% of Ni, and from 0.30 to 5.0% of Cr, the balance being Fe and unavoidable impurities, having on its surfaces hot dip coated aluminum layers.

* * * * *